United States Patent [19]

Cartmill

[11] 3,991,470

[45] Nov. 16, 1976

[54] CHAIN SAW GUARD STRUCTURE

[75] Inventor: William Glenn Cartmill, Pauls Valley, Okla.

[73] Assignees: Charles R. Musgrave, III; E. L. Jackson; William Cartmill, all of Pauls Valley, Okla. ; part interest to each

[22] Filed: Jan. 22, 1976

[21] Appl. No.: 651,611

[52] U.S. Cl. ..... 30/382
[51] Int. Cl.[2] ..... B27B 17/02
[58] Field of Search..... 30/382, 391, 161

[56] References Cited

UNITED STATES PATENTS

| | | | |
|---|---|---|---|
| 2,937,673 | 5/1960 | Duperron | 30/382 X |
| 3,059,673 | 10/1962 | Woleslagle | 30/161 |
| 3,327,743 | 6/1967 | Long | 30/382 X |
| 3,384,136 | 5/1968 | Marin | 30/382 |
| 3,805,639 | 4/1974 | Peter | 30/391 |

*Primary Examiner*—Al Lawrence Smith
*Assistant Examiner*—J. C. Peters
*Attorney, Agent, or Firm*—Laney, Dougherty, Hessin & Fish

[57] ABSTRACT

A chain saw guard which includes a two-part base structure mountable on the housing and chain guide plate of a chain saw, and a pair of subframes pivotally mounted on the base structure. One subframe includes a pair of lateral frame members positioned on opposite sides of the chain guide plate and a third frame member positioned over the upper run of the chain, and the subframe is pivotable upwardly about an axis positioned near the saw housing to a position exposing the upper run of the blade. The other subframe is constructed similarly to the first but is positioned to protect and guard the lower run of the chain, and is mounted on the base structure to pivot downwardly about an axis positioned near the saw housing.

16 Claims, 6 Drawing Figures

CHAIN SAW GUARD STRUCTURE

BACKGROUND OF THE INVENTION

1. Field of the Invention

This invention relates to chain saw guard structures of the type which are movably mounted on the chain saw for pivotation from a guarding position near to the blade of the saw to an operating position which permits the saw blade to cut through a log or the like.

2. Brief Description of the Prior Art

Many structures have previously been manufactured and sold which are intended to function as effective guards for chain saws and are utilized with such saws to prevent injury of an operator. Such guards generally provide rigid structures which enclose the chain saw guide plate and the chain saw blade when the saw is not being used to cut through a log or other structure. Many such chain saw guards are pivotally supported at one end adjacent the chain saw housing so as to permit the guard to be pivoted to a non-interfering position at a time when the saw blade is being used to cut through a log, and to still afford some protection to the hands and arms of the user even at these times. The guard structures so provided frequently include a protective frame or housing which swings upwardly due to the displacing action of a part of the log above the lower or cutting run of the chain saw blade, with the housing or frame being pivoted further upwardly as the chain saw progresses further through the log to be cut. With some types of chain saw guards, a portion of the guard is positioned alongside the lower or bottom run of the chain saw blade to afford protection at that location. However, such lower guard structures are, for the most part, made semi-permanent in their position in relation to the chain saw blade, and thus decrease, to some extent, the facility and flexibility of operation of the chain saw.

Chain saw guard structures of the types described are depicted in U.S. Pat. No. 3,230,987 to Woleslagle; U.S. Pat. No. 2,937,673 to Duperron et al.; U.S. Pat. No. 3,380,493 to Giroux; U.S. Pat. No. 3,754,328 to Knerr; U.S. Pat. No. 3,384,136 to Marin et al.; U.S. Pat. No. 3,182,695 to Rigoni; U.S. Pat. No. 3,808,684 to Ludwig; and U.S. Pat. No. 3,059,673 to Woleslagle.

In general, guard structures for chain saws of the type described, and which have been marketed previously, while providing good protection from inadvertent injury by contact with the saw blade during its use, have failed to provide complete protection for the feet, legs, hands and arms of the user during all phases of use of the saw. Some types of guards are pivotally mounted on the housing of the saw so as to pivot to one position or another either above the saw blade or below it during use of the saw, but complete protection by the provision of a pair of completely shielding pivotal subframes which guard both the upper run and the lower run of the saw blade during all times of usage or non-usage of the saw has not been provided. Moreover, many of the types of chain saw guards previously in use have been relatively heavy in their construction, and such weight, when added to the chain saw, makes these guard structures unattractive to the user when a heavy-duty saw is employed over extended periods of usage, with little time for rest or relaxation on the part of the user. Further, some of the guard structures provided have been expensive as a result of the operating mechanism used, and the provision of a solid, completely enclosing housing which extends around a major portion of the blade and includes a substantial quantity of metal.

BRIEF DESCRIPTION OF THE PRESENT INVENTION

The present invention is a chain saw guard structure which is relatively light in weight, mechanically strong and sturdy in construction and which functions both during non-use, as well as during any type of use of the chain saw upon which it is mounted, to protect the entire exposed length of the chain blade from contact with any portion of the anatomy of the user. The guard also protects the blade of the chain saw from contact with the ground or with objects which might dull the teeth of the chain saw blade.

Broadly described, the chain saw guard structure of the present invention comprises a base structure by means of which the guard structure can be quickly mounted on a chain saw, and a pair of spaced subframes pivotally connected to the base structure and extending therefrom along the blade of the saw in a protective position. Each of the subframes includes a pair of lateral frame members extending along opposite sides of the chain guide plate, and each subframe further includes a central frame member which lies in substantially the same plane as the chain guide plate and the chain runs carried and guided thereby. The subframes are independently pivotable in opposite directions from each other about axes near the chain saw housing to expose the teeth of the chain saw runs on each side of the chain saw guide plate. Each subframe preferably also includes an arcuate horn portion projecting from the outer end of the respective subframe with the two horn portions diverging from each other to provide an entryway for logs, limbs or other members to be cut with the saw.

An important object of the invention is to provide a chain saw guard structure which can be utilized as a quickly mounted structure, on many types of chain saws now manufactured.

An additional object of the present invention is to provide an effective chain saw guard structure which prevents inadvertent contact of the saw blade by users of the saw, but which is relatively light in construction and does not add substantially to the overall total weight of the saw.

A further object of the invention is to provide a chain saw guard structure which does not have interfering protuberances and does not have knobs, levers or catches which must be operated by the saw operator in order to cause the chain saw guard structure to function.

An additional object of the ivention is to provide a chain saw guard structure which, when mounted on a chain saw, includes only two moving parts which can move independently of each other to provide a guarding function for different parts of the chain saw blade at different times during its use.

Another object of the invention is to provide a chain saw guard structure which is characterized by mechanical strength and a long and trouble-free operating life.

Additional objects and advantages of the invention will become apparent as the following detailed description of the invention is read in conjunction with the accompanying drawings which illustrate the invention.

GENERAL DESCRIPTION OF THE DRAWINGS

FIG. 1 is a side elevation view of the chain saw guard structure of the present invention as it appears in one position when mounted on the chain saw. The housing of the chain saw, the chain saw guide and blade, a log being cut by the chain saw and the operative cutting position of the two primary guard subframes of the chain saw guard are all shown in dashed lines to illustrate the context and operative characteristics of the chain saw guard structure of the invention.

DETAILED DESCRIPTION OF A PREFERRED EMBODIMENT OF THE INVENTION

Figure 1:
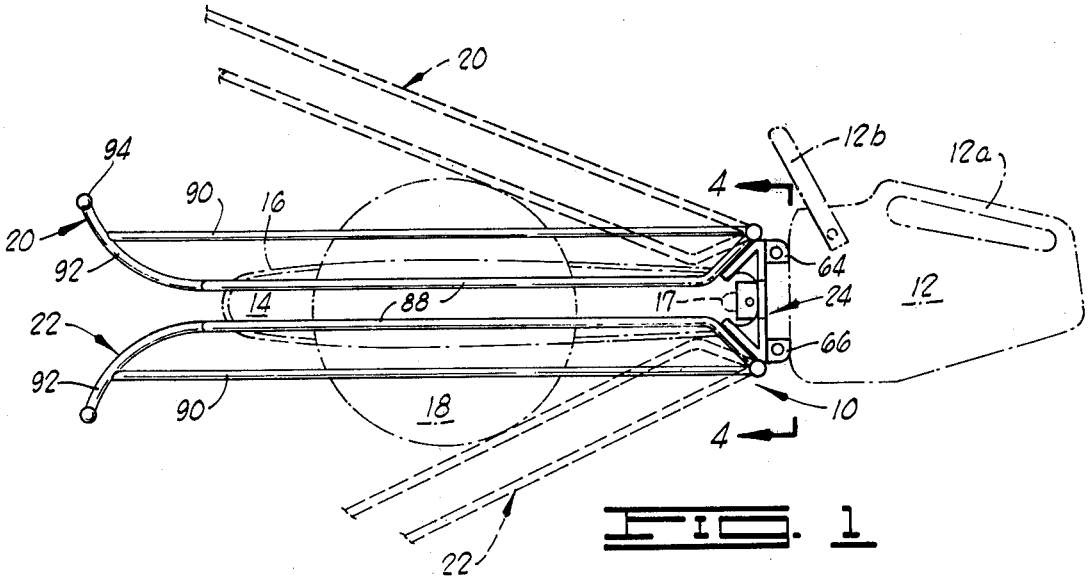

Referring initially to FIG. 1 of the drawings, shown therein is a chain saw guard structure constructed in accordance with the present invention, and designated generally by reference numeral 10. The chain saw guard structure 10 is shown secured at one of its ends to the rigid housing 12 of a chain saw. The housing 12 carries a first handle 12*a* and a second handle 12*b*. A chain saw guide plate 14 projects in conventional fashion from the forward side of the chain saw housing 12 and acts as a guide for supporting a flexible chain saw blade 16 in a manner well understood by those skilled in the art. An elongated slot 17 is provided in the chain saw blade 16 and extends along its axis at a location near the housing 12 for a purpose hereinafter described.

For the purpose of illustrating the status of the chain saw guard structure 10 at different times during the operation of a chain saw upon which the guard structure is mounted, a log 18 is illustrated in FIG. 1 in dashed lines. The chain saw blade 16 is shown in dashed lines passing through the central portion of this log. The chain saw guard structure 10 includes a pair of pivotally mounted subframes, designated generally by reference numerals 20 and 22, and these subframes are hereinafter described in detail. For the purpose of the instant discussion, it may be pointed out that during the use of the chain saw to cut through a log or limb, the subframes 20 and 22 are mounted to pivot to the positions shown in dashed lines in FIG. 1.

Referring to FIGS. 3–6 of the drawings, the chain saw guard structure 10 further includes a two-part base structure, designated generally by reference numeral 24, which base structure functions to pivotally support the two subframes 20 and 22. The two parts of the base structure are a guide plate receiving part 26, and a mounting part 28. The mounting part 28 includes a back plate 30 having a pair of inclined subframe stop plates 32 and 34 connected to the upper and lower edges, respectively, of the base plate 30, and inclined at an angle of about 45° with respect to the major plane of the back plate. Preferably, reinforcing gusset plates 36 and 38 are secured in the angles between the back plate 30 and the inclined subframe stop plates 32 and 34 in the locations best illustrated in FIGS. 3 and 6.

Secured to the inner edge of the mounting part 28 of the two-part base structure 24, and projecting normal to the back side of the back plate 30 thereof, is a mounting plate 40. The mounting plate 40 has a rearwardly projecting tongue portion 40*a* adapted for extension along one side of the housing 12 of the chain saw, and having a bolt aperture 42 formed therein. A pair of opposed ears 40*b* and 40*c* are formed at the upper and lower sides of the mounting plate 40 and are provided with bolt-receiving apertures (not visible) for receiving, respectively, a pair of bolts 44 and 46 for a purpose hereinafter described. A final element of the mounting part 28 is a spacing block 47 which is secured to the inner edge of the back plate 30 and projects forwardly therefrom alongside the chain guide plate 14. A bolt opening or aperture is formed through the spacing block 47 at a location which is in alignment with the slot 17 in the chain saw guide plate 14.

The guide plate receiving part 26 of the two-part base structure 24 includes a back plate 48 which is configured generally similarly to the back plate 30 of the mounting part 28, except for having a wider transverse overall dimension. A pair of inclined subframe stop plates 50 and 52 are secured to the upper and lower edges, respectively, of the back plate 48 and are inclined at an angle of about 45° with respect to the back plate. A pair of reinforcing gusset plates 54 and 56 are interposed in the angles between the back plate 48 and the inclined subframe stop plates 50 and 52, respectively.

At the inner longitudinal edge of the back plate 48, the plate is relieved to provide a generally rectangular slot or recess 58 projecting into the plate from this edge of the back plate. The relief 58 has a defining inner edge 58*a* to which is secured a spacing block 60. The spacing block 60 projects forwardly from the back plate 48 and normal thereto, and, when the two-part base structure 24 is asembled in a manner hereinafter described, extends substantially parallel to the spacing block 47 carried by the mounting part 28 at the location hereinbefore described. In referring to FIGS. 3 and 4, it will be noted that the slot or recess 58 is sufficiently large to facilitate the extension therethrough of the chain saw guide plate 14 and the chain saw blade 16. The spacing block 60 is provided with a bolt-receiving aperture 62 formed through the center thereof and in alignment with the slot 17 in the guide plate 14, for the purpose of receiving a clamping bolt used in the assembly of the two-part base structure in a manner hereinafter described.

Projecting rearwardly from the back plate 48 of the guide receiving part 26 of the base structure 24 are a pair of engagement lugs or ears 64 and 66. The engagement lugs 64 and 66 are located at the upper and lower sides, respectively, of the back plate 48, and are positioned immediately adjacent the inner edge of the back plate. Each engagement lug has a bolt aperture formed therethrough to receive the bolts 44 and 46 when the base structure 24 is assembled.

A tubular bearing cup 68 is secured by welding or other suitable means to the upper edge of the back plate 30 of the mounting part 28 at a location where the back plate is joined to the inclined subframe stop plate 32. A similar tubular bearing cup 70 is secured to the lower edge of the back plate 30 adjacent the outer side thereof, and at the location where the back plate is joined to the inclined subframe stop plate 34 (see FIGS. 3 and 6). In like fashion, a tubular bearing cup 72 is secured to the upper edge at the outer side of the back plate 48 of the guide receiving part 26, and a similar tubular bearing cup 73 is secured to the lower edge of this back plate at the outer side thereof.

Figure 4:
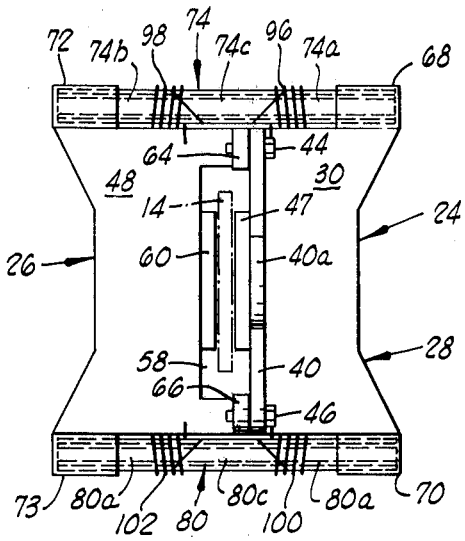
FIG. 4 is a sectional view taken along line 4—4 of FIG. 1.

In assembling the two-part base structure 24 made up, broadly speaking, of the guide receiving part 26 and the mounting part 28, the mounting part is secured alongside the chain saw housing 12 by passing a suitable securing bolt through the bolt aperture 42 and into an aligned threaded bolt receiving aperture (not visible) formed in the side of the housing 12. The spacing block 47 is thereby positioned alongside the chain guide plate 14 so as to flatly abut the chain guide plate with the bolt aperture through the spacing block 47 aligned with the elongated slot 17 formed in the center of the chain guide plate 14. The guide plate receiving part 26 of the base structure 24 is then positioned on the opposite side of the chain guide plate 14 so that the spacing block 60 bears flatly against the chain guide plate 14 with the bolt-receiving aperture 62 therein aligned with the elongated slot 17 in the chain guide plate. The positioning of the guide plate receiving part 26 is such that the engagement lugs 64 and 66 carried thereby bear against the ears **40*b* and 40 *c* of the mounting plate 40, with the bolt-receiving holes or apertures in the lugs aligned with similar apertures formed through the ears 40*b* and 40*c* of the mounting plate as shown in FIG. 4. With the guide plate receiving part 26 and the mounting part 28 of the two-part base structure 24 in the described position, suitable securing and clamping bolts 44 and 46 are then passed through the apertures in the lugs 64 and 66 carried on the guide plate receiving part 26, and the aligned counterpart apertures in the ears 40*b* and 40*c* of the mounting plate 40. A clamping bolt 75 is also passed through the aligned bolt-receiving apertures in the spacing blocks 47 and 60 to clamp the two spacing blocks against the opposite sides of the chain saw guide plate 14**.

Figure 3:
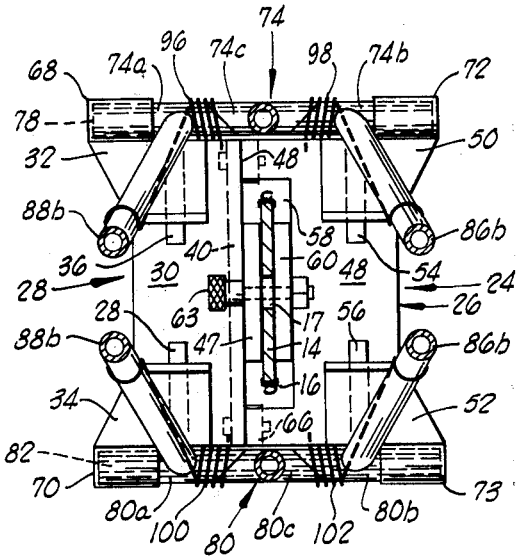
FIG. 3 is a sectional view taken along line 3—3 of FIG. 2 and enlarged to better illustrate details of the depicted structure.

Extending between the tubular bearing cups 68 and 72 which are carried at the upper side of the two-part base structure 24, and are horizontally spaced in the manner shown in FIG. 3 is a segmented bearing sleeve designated generally by reference numeral 74. The segmented bearing sleeve 74 includes a pair of opposed, substantially identically shaped end parts **74*a* and 74*b*. Each of the end parts 74*a* and 74*b* of the segmented sleeve 74 has an outer end portion of cylindrical configuration, which outer end portion is rotatably telescoped, or concentrically positioned, within a respective one of the tubular bearing cups 68 or 72. At the inner end of each of the sleeve end parts 74*a* and 74*b*, each sleeve end part is cut away in an angular fashion along a plane extended at an angle of about 45° with respect to the longitudinal axis of the segmented bearing sleeve 74**.

As thus formed, the inner ends of the end parts **74*a* and 74*b* register or mate with the similarly angled or bias cut ends of a central part 74*c* of the segmented bearing sleeve 74 so that the three parts, 74*a*, 74*b* and 74*c*, when fitted together in the manner illustrated in FIGS. 3 and 4, form an elongated tubular member, the opposite ends of which are positioned rotatably within the tubular bearing cups 68 and 72. For the purpose of retaining the end parts 74*a* and 74*b* and the central part 74*c* in axial alignment, with the bias cut end edges of the several parts mating in the manner shown, an assembly pin 78 having substantially the same overall length as the mated parts 74*a*, 74*b* and 74*c*, but being of sufficiently small diameter to fit within these tubular parts, in extended co-axially within the segmented bearing sleeve 74 and concentrically within the tubular bearing cups 68 and 72**.

A similar construction is used in the provision of a second segmented bearing sleeve 80 which includes end parts **80*a* and 80*b* having portions positioned concentrically and rotatably within the tubular bearing cups 70 and 73, and further having a central part 80*c* disposed between, and aligned with, the end parts 80*a* and 80*b*. Again, the inner ends of the end parts 80*a* and 80*b* are cut along a plane extending at an angle to the axis of the segmented bearing sleeve 80, and the central part 80*c* is cut along the same angle in a reverse sense so that its opposite ends mate with the end edges of the end parts 80*a* and 80*b* as shown in FIGS. 3 and 4. In a construction identical to the construction of the segmented bearing sleeve 74 and the associated assembly pin 78, an assembly pin 82 is extended concentrically through the two end parts 80*a* and 80*b* of the segmented bearing sleeve 80, and also through the central part 80*c* thereof. The purpose of the segmented construction of the bearing sleeves 74 and 80** will be hereinafter explained in greater detail.

Figure 2:
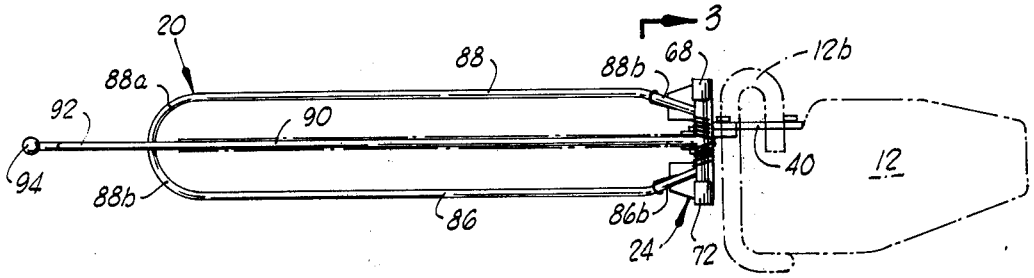
FIG. 2 is a top plan view of the chain saw guard structure of the invention illustrating, in dashed lines, the chain saw blade and the housing of the chain saw.
Figure 5:
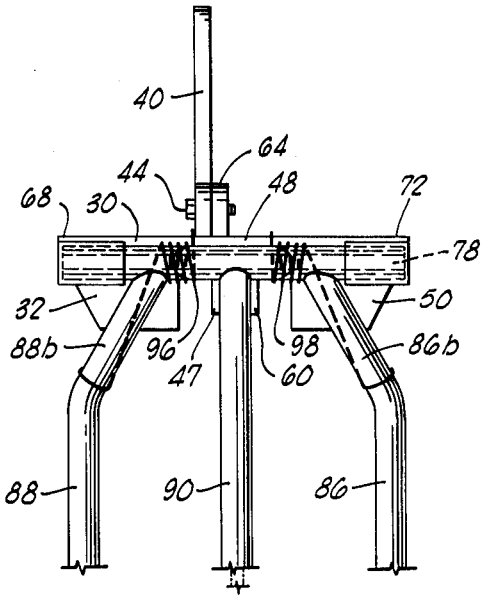
FIG. 5 is a plan view of the portion of the chain guard structure of the present invention which is disposed immediately adjacent the housing of the chain saw.
Figure 6:
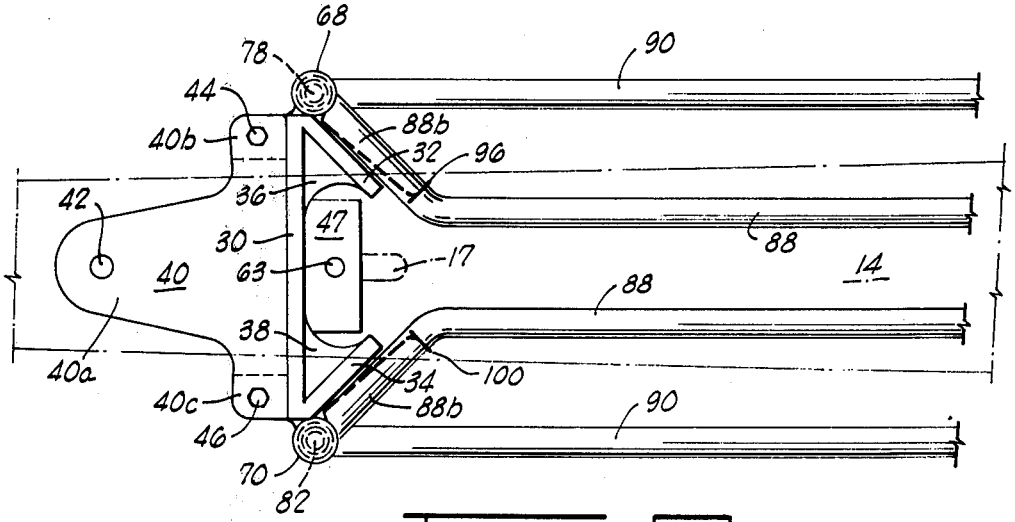
FIG. 6 is an enlarged side elevational view of the portion of the chain saw shown in plan view in FIG. 5.

The subframes 20 and 22, hereinbefore mentioned, are identically constructed. Each is constructed of frame members which include a pair of lateral chain guard tubes or bars 86 and 88, a central overlying chain guard tube or bar 90 and an arcuate horn portion 92. It will be noted in referring to FIGS. 1 and 2 that each of the lateral chain guard tubes 86 and 88 of each of the subframes 20 and 22 includes a generally arcuate outer end portion (**86*a* and 88*a*, respectively), which end portions are joined together to form a semi-circular loop extending around, and spaced from, the outer end of the chain saw guide plate 14 and the chain saw blade 16 carried thereby. At the opposite ends of the lateral chain guard tubes 86 and 88, these tubes are provided with upwardly and inwardly bent inner end portions 86*b* and 88*b*, respectively. The upwardly and inwardly bent end portions 86*b* and 88*b* are bent out of a vertical plane, as the guard tubes are viewed in FIG. 2, so as to form an angle of about 30° with such vertical plane. Stated differently, the inner end portions 86*b* and 88*b* are turned inwardly in the direction of the opposite one of the lateral chain guard tubes 86 or 88 so that these inner end portions converge. The end portions 86*b* and 88*b* are also bent out of horizontal planes extending through each of these guard tubes so as to incline upwardly at an angle of about 45° in the manner shown in FIG. 1. In this position, the inner end portions 86*b* and 88*b* of the guard tubes 86 and 88 extend flatly across the upper surface of the inclined subframe stop plates 32 and 34 at the upper side of each of the two parts of the base structure 24, and have their inner ends secured by welding or other suitable means to the end parts 74*a* and 74*b* of the segmented bearing sleeve 74 as best shown in FIGS. 3 and 5. Substantially the same or an identical geometric configuration is characteristic of the lateral chain guard tubes 86 and 88 forming a part of the lower subframe 22, except that the inner end portions 86*b* and 88*b* thereof are bent downwardly through an angle of 45° with respect to the horizontal plane of the guard tubes 86 and 88, and in this orientation project flatly along and against the lower side of the inclined subframe stop plates 50 and 52 disposed at the lower side of the two parts of the base structure 24.**

The arcuate horn portion 92 of each of the subframes 20 and 22 has its inner end welded or otherwise suitably secured to the extreme outer end of the semi-circular loop which extends around the outer end of the chain saw guide plate 14. From this point, each arcuate horn portion extends upwardly and has its central portion joined to the outer end of the overlying chain guard tube or bar 90. Each arcuate horn portion 92 terminates in a ball or spherical portion 94 at its upper outer end, which ball or sperical portion is a safety feature preventing impalement or abrasion resulting from bodily contact with the outer ends of the horn portions. It will be noted in referring to FIG. 1 that the arcuate horn portions 92 on the two subframes 20 and 22 are mounted in a divergent fashion so that a throat is formed which is relatively wide at the outer end, but which converges to a relatively narrow cross-section at the inner end of the two arcuate horn portions.

Extending around the outer end part 74*a* of the segmented sleeve 74 are the convolutions of a torsion spring 96. The torsion spring 96 then loops beneath the end part 74*a* of the segmented sleeve 74 and has a straight portion which extends along the inwardly bent end portion 88*b* of the lateral chain guard tube 88. At its outer end, this end portion of the torsion spring 96 hooks over the top side of the inner end portion 88*b* of the chain guard tube 88. At the opposite end of the torsion spring 96, an end portion thereof is extended downwardly and to the rear side of the back plate 30. With this arrangement, the torsion spring is loaded in tension when the subframe 20 is pivoted upwardly from its position shown in full lines in FIG. 1 toward the position thereof shown in dashed lines in the same Figure. Stated differently, the torsion spring 96 constantly acts to exert a resilient bias against the chain guard tube 88 to cause this tube to be pivoted downwardly, and with it, the entire subframe 20 of which it is a part.

In similar fashion, a second torsion spring 98 has its convolutions disposed about the end part 74*b* of the segmented sleeve 74 and has one end portion which extends outwardly along the inner end portion 86*b* of the chain guard tube 86. This end portion has a hook extended over the top side of the inner end portion 86*b* of the chain guard tube 86. The opposite end of the torsion spring 98 is extended downwardly behind the back plate 48 of the chain guide plate receiving part 26. The torsion spring 98 exerts a bias tending to resist pivotal movement of the upper subframe 20 from the solid line position to the dashed line position illustrated in FIG. 1, and functions to return this subframe to its closed, blade-protecting position after sawing of a log or other structure has been completed.

In a manner similar to the arrangement and function of the torsion springs 96 and 98 provided at the upper side of the two-part base structure 24 and around the segmented bearing sleeve 74 in the manner described, a pair of torsion springs 100 and 102 are provided around the segmented bearing sleeve 80 carried at the lower side of the two-part base structure 24 and pivotally supported in the tubular bearing cups 70 and 73. The torsion springs 100 and 102 function to resiliently oppose pivotal movement of the lower subframe 22 from its full line position towards its dashed line position as these positions are shown in FIG. 1, and to return the lower subframe 22 to its blade-protecting position after the saw has been used.

In the construction of the chain saw guard structure of the invention, each of the chain guard subassemblies 20 and 22 is initially constructed by welding the frame elements constituted by the various guard tubes or bars 86, 88 and 90 and arcuate horn portions 92 together, and securing the inner ends of the guard tubes or bars 86, 88 and 90 to an unsegmented sleeve. After the construction of the guard subframes has thus been completed by welding or other suitable means of securement, the bearing sleeves are cut in the manner hereinbefore described to form the end parts 74*a* and 74*b* and 80*a* and 80*b*, along with the central parts 74*c* and 80*c*. After cutting the bearing sleeves along planes inclined to the axis of the uncut sleeve to form the segmented bearing sleeves described, the central parts 74*c* and 80*c* can be removed from the bearing sleeves to permit the torsion springs 96, 98, 100 and 102 to be slipped into place around the inner, bias cut end portions of the several end parts 74*a*, 74*b*, 80*a* and 80*b*. The central parts 74*c* and 80*c* of each of the two segmented bearing sleeves is then slipped back into position, and the alignment pins 78 and 82 are inserted in the respective segmented bearing sleeves. It may here by pointed out that the cutting of the bearing sleeves along the two planes extending at angles of about 45° to the longitudinal axes of the bearing sleeves to segment the bearing sleeves into the 3 parts described, not only permits the central part to be removed so that the torsion springs can be installed following welding, but, because of the keying interengagement or mating action of the two bias cut end edges of the end parts with the central parts in the respective segmented bearing sleeves 74 and 80, a portion of the torque which is transmitted directly to the two lateral chain guard tubes 86 and 88 is ultimately also transmitted to the central overlying chain guard tubes 90 in the two subframes. Therefore less stress is imparted to the weld point at which the central overlying chain guard tube 90 is joined to the arcuate horn portion 92.

It will be perceived that in the course of assembling the chain saw guard structure of the invention, the segmented tubular bearing sleeves 74 and 80 and their enclosed alignment pins 78 and 82 are initially mounted in the structure so that one end part 74*a* or 74*b* and 80*a* or 80*b* is telescopingly inserted within one of the tubular bearing cups at the top of the two-part base structure 24 and a corresponding one of the tubular bearing cups at the lower side of the two-part base structure. After this, the mounting part 28 and the guide plate receiving part 26 can be joined together and connected to the housing 12 of the chain saw in the manner hereinbefore described. It may be further noted that the adjustment of tension in the chain saw blade which is usually effected by moving the chain saw guide plate 14 longitudinally to increase or relax the tension in the chain saw blade is not impaired by mounting of the chain saw guard structure of the present invention on the chain saw, since such longitudinal movement of the chain saw guide plate 14 is accommodated by the length of the slot 17 therein through which the clamping bolt 63 is extended when the guide plate receiving part 26 is joined to the mounting part 28 of the two-part base structure 24.

In the utilization of the chain saw guard structure of the invention, the two pivoted subframes 20 and 22 occupy the at-rest (saw inoperative) guarding position shown in full lines in FIG. 1. Thus, by reason of the positioning of the lateral guard tubes or bars 88 and 86 on opposite sides of the blade and the two central overlying chain guard tubes 90 over the top and bottom runs of the chain saw blade, an operator is prevented from inadvertently kicking or running an arm or hand across the exposed chain saw blade. Moreover, the arcuate horn portions 92 projecting beyond the end of the chain saw blade, in conjunction with the loops or arcuate end portions 86*a* and 88*a* formed on the ends of the lateral chain saw tubes 86 and 88 protect the end of the chain saw blade from accidental contact therewith by a person. It will also be noted that the two subframes 20 and 22 when in the saw-inoperative position shown in dashed lines in FIG. 1, protect the chain saw blade from contact with the ground or with a hard surface which might tend to dull the blade.

During use of the chain saw having the chain saw guard structure of the present invention mounted thereon, the log or other wooden structure to be cut through by the chain saw is first guided through the arcuate horn portions 92 of the upper and lower subframes 20 and 22. As the log moves inwardly toward the tip of the chain saw blade, it bears against the arcuate horn portions, and thus smoothly and evenly biases the two subframes 20 and 22 apart from each other. The person using the saw will, most frequently, desire to place the saw blade and the saw blade supporting plate 14 on the upper side of the log and cut down through the log.

When this more conventional mode of usage is employed, little difficulty is experienced in lifting the chain saw blade and its guide plate 14 upwardly, and with them, the upper subframe 20. In other words, for this mode of operation, the upper subframe 20 remains in its guarding position across the upper portion of the plate 14 and the chain saw blade 16. The lower subframe 22, however, is biased downwardly as much as is needed in order to permit the log to pass beneath the lower run of the chain saw blade 16 in preparation for cutting through the log. This presents no particular difficulty since the upper and lower subframes are each capable of pivoting through an angle of at least 90° in relation to the longitudinal axis of the saw blade.

After the log has been cut through and the end portion which has been cut off of the log falls away, the two subframes 20 and 22 will immediately be biased back to their full line positions shown in FIG. 1 so as to provide complete protection from inadvertent contact with the sharp teeth of the chain saw blade.

From the foregoing description of the invention, it will be perceived that the present invention provides a highly useful, mechanically strong yet inexpensively constructed chain saw guard structure. Although a preferred embodiment of the invention has been herein illustrated and described, it will be understood that certain changes and refinements in the illustrated and described structure can be effected without departure from the basic principles of the invention. Changes and innovations of this type are therefore deemed to be circumscribed by the spirit and scope of the invention except as such changes are excluded by the language of the appended claims or reasonable equivalents thereof.

What is claimed is:

1. A chain saw guard structure comprising:

a two-part base structure adapted for detachable securement to a chain saw housing;

an elongated first subframe pivotally connected at one of its ends to said base structure for pivoting from a first position extending from said base structure substantially parallel to, and adjacent one of, the runs of the blade of a chain saw upon which said guard structure is mounted, to a second position in which said first subframe extends at an angle of about 90° to said one run of the blade of a chain saw upon which said guard structure is mounted;

an elongated second subframe pivotally connected at one of its ends to said base structure for pivotation about an axis extending substantially parallel to the pivotal axis of said first subframe, and pivotable from a first position extending from said base structure substantially parallel to said first subframe and on the opposite side of said chain saw blade from said first subframe, to a second position in which said second subframe extends at an angle of about 90° with respect to the first described position of said second subframe; and means for resiliently biasing said first and second subframes from their respective second positions to their respective first positions.

2. A chain saw guard structure as defined in claim 1 wherein said two-part base structure comprises:

a chain saw guide plate receiving part having a recess therein for receiving a chain saw guide plate and a flexible chain saw blade carried thereon;

a mounting part adapted for securement to the housing of a chain saw; and means for detachably inerconnecting the guide plate receiving part and the mounting part for positioning the guide plate receiving part and the mounting part on opposite sides of a chain saw guide plate while said mounting part is secured to the housing of the chain saw.

3. A chain saw guard structure as defined in claim 2 wherein said mounting part includes:

a back plate having two opposed sides and two substantially parallel edges defining boundaries of said sides;

a tongue portion projecting from one side of said back plate in a direction normal to the plane of said back plate and adapted for connection to said chain saw housing; and a pair of opposed inclined subframe stop plates secured to said parallel edges of said back plate and projecting toward each other from the opposite side of said back plate from the side thereof from which said tongue portion projects; and wherein said guide plate receiving part includes:

a back plate having said recess therein and positioned in substantially coplanar alignment with the back plate of said mounting plate, and having two opposed sides, and two substantially parallel edges defining boundaries of said sides and aligned with the two parallel edges of said mounting part; and a pair of opposed inclined subframe stop plates secured to said parallel edges of the back plate of said guide plate receiving part, and positioned in coplanar alignment with the pair of opposed inclined subframe stop plates which are secured to the parallel edges of the back plate of said mounting part, said first elongated subframe having one of its ends pivotally connected to two aligned edges of said mounting part back plate and said guide plate receiving part back plate, and said second elongated subframe having one of its ends pivotally connected to the other two aligned edges of said mounting part back plate and said guide plate receiving part back plate.

4. A chain saw guard structure as defined in claim 3 wherein each of said subframes comprises:

a pair of parallel lateral frame members extending from said two-part base structure and joined through a curved end portion at their ends remote from said two-part base structure;

a central frame member extending parallel to said lateral frame members and disposed out of the common plane occupied by said lateral frame members to be spaced above the saw blade while said lateral frame members are spaced on opposite sides of a flat guide plate carrying said saw blade; and an arcuate horn portion having an end secured to said curved end portion and a medial portion secured to said central frame member.

5. A chain saw guard structure as defined in claim 3 and further characterized as including:

a tubular bearing cup secured to each of said parallel edges of said back plates with the two tubular bearing cups on said mounting part back plate spaced from the two bearing cups on said guide plate receiving part back plate;

first bearing means journaled in two of said tubular bearing cups and having said first subframe secured thereto for pivotation therewith in said tubular bearing cups; and second bearing means journaled in the remaining two of said tubular bearing cups and extending substantially parallel to said first bearing means, said second bearing means having said first subframe secured thereto for pivotation therewith in said remaining two tubular bearing cups.

6. A chain saw guard structure as defined in claim 5 wherein said first and second bearing means each comprises:

a segmented bearing sleeve journaled in said bearing cups, said segmented bearing sleeve including:

a tubular central part; and a pair of tubular end parts disposed adjacent, and aligned with, opposite ends of said tubular central part; and an alignment pin extending through and concentrically within said tubular central part and tubular end parts.

7. A chain saw guard structure as defined in claim 5 wherein said means for resiliently biasing said first and second subframe comprises:

a first pair of torsion springs around said first bearing means and each having an end abutting one of said back plates and an end engaging one of said subframes; and a second pair of torsion springs around said second bearing means and each having an end abutting one of said back plates and an end engaging the other of said subframes.

8. A chain saw guard structure as defined in claim 3 and further characterized as including engagement lugs projecting from the opposite side of the back plate of said guide plate receiving part from the side from which said last mentioned pair of subframes stop plates projects;

and wherein said means for detachably interconnecting said guide plate receiving part and said mounting part comprises:

bolts extending through and interconnecting said engagement lugs and said tongue portion.

9. A chain saw guard structure as defined in claim 3 and further characterized as including:

a first apertured spacing block projecting from said mounting part back plate at a location between said subframe stop plates carried thereby; and a second apertured spacing block projecting from the back plate of said guide plate receiving part and having the aperture therein aligned with the aperture in said first apertured spacing block; and means for interconnecting said first and second spacing blocks.

10. A chain saw guard structure as defined in claim 9 and further characterized as including engagement lugs projecting from the opposite side of the back plate of said guide plate receiving part from the side from which said last mentioned pair of subframes stop plates project;

and wherein said means for detachably interconnecting said guide plate receiving part and said mounting part comprises:

bolts extending through and interconnecting said engagement lugs and said tongue portion.

11. A chain saw guard structure as defined in claim 10 and further characterized as including:

a tubular bearing cup secured to each of said parallel edges of said back plates with the two tubular bearing cups on said mounting part back plate spaced from the two bearing cups on said guide plate receiving part back plate;

first bearing means journaled in two of said tubular bearing cups and having said first subframe secured thereto for pivotation therewith in said tubular bearing cups; and second bearing means journaled in the remaining two of said tubular bearing cups and extending substantially parallel to said first bearing means, said second bearing means having said first subframe secured thereto for pivotation therewith in said remaining two tubular bearing cups.

12. A chain saw guard structure as defined in claim 11 wherein said means for resiliently biasing said first and second subframes comprises:

a first pair of torsion springs around said first bearing means and each having an end abutting one of said back plates and an end engaging one of said subframes; and a second pair of torsion springs around said second bearing means and each having an end abutting one of said back plates and an end engaging the other of said subframes.

13. A chain saw comprising:

a housing having handle means thereon;

an elongated chain guide plate projecting from one side of said housing;

a flexible saw blade extended around said chain guide plate and including an upper run and a lower run;

a chain saw guard base structure mounted on said housing;

an elongated first subframe pivotally connected at one of its ends to said chain saw guard base structure and including:

a pair of lateral chain guard frame members extending along said guide plate on opposite sides thereof; and a central chain guard frame member disposed between said lateral chain guard frame members and lying substantially in the plane of said chain guide plate in a position spaced from the upper run of said saw blade; and an elongated second subframe pivotally connected at one of its ends to said chain saw guard base structure for pivotation about an axis extending substantially parallel to the pivotal axis of said first subframe, said second subframe including means extending along and protecting the lower side of said flexible chain saw blade.

14. A chain saw as defined in claim 13 wherein said chain saw guard base structure includes two parts detachably interconnected to each other through said chain guide plate and disposed on opposite sides of said chain guide plate.

15. A chain saw as defined in claim 14 wherein one of said parts is slotted to accommodate and receive said guide plate in said slot, and the other of said parts includes a tongue portion connected to said housing.

16. A chain saw as defined in claim 13 wherein said chain saw guard base structure comprises:

a chain saw guide plate receiving part having a recess therein for receiving a chain saw guide plate;

a mounting part detachably connected to said housing; and means for detachably interconnecting said chain saw guide plate receiving part and said mounting part for positioning the guide plate receiving part and the mounting part on opposite sides of said chain guide plate and adjacent said housing.

* * * * *